US010734729B2

(12) United States Patent
Coupez

(10) Patent No.: US 10,734,729 B2
(45) Date of Patent: Aug. 4, 2020

(54) CONFIGURABLE MULTIBAND ANTENNA ARRANGEMENT WITH WIDEBAND CAPACITY AND DESIGN METHOD THEREOF

(71) Applicant: INSTITUT MINES-TELECOM / TELECOM BRETAGNE, Brest (FR)

(72) Inventor: Jean-Philippe Coupez, Brest (FR)

(73) Assignee: INSTITUT MINES-TELECOM/TELECOM BRETAGNE, Brest (FR)

( * ) Notice: Subject to any disclaimer, the term of this patent is extended or adjusted under 35 U.S.C. 154(b) by 229 days.

(21) Appl. No.: 15/849,205

(22) Filed: Dec. 20, 2017

(65) Prior Publication Data

US 2018/0183144 A1 Jun. 28, 2018

(30) Foreign Application Priority Data

Dec. 22, 2016 (EP) ..... 16306768

(51) Int. Cl.

| | |
|---|---|
| ***H01Q 9/30*** | (2006.01) |
| ***H01Q 5/371*** | (2015.01) |
| ***H01Q 1/36*** | (2006.01) |
| ***H01Q 5/342*** | (2015.01) |

(Continued)

(52) U.S. Cl.

CPC ..... *H01Q 9/30* (2013.01); *H01Q 1/36* (2013.01); *H01Q 1/362* (2013.01); *H01Q 1/44* (2013.01); *H01Q 5/342* (2015.01); *H01Q 5/371* (2015.01); *H01Q 9/16* (2013.01)

(58) Field of Classification Search

CPC ..... H01Q 9/42; H01Q 9/43; H01Q 9/0407; H01Q 9/0442; H01Q 5/371

See application file for complete search history.

(56) References Cited

U.S. PATENT DOCUMENTS

| | | | |
|---|---|---|---|
| 2009/0174616 | A1 | 7/2009 | Kim et al. |
| 2013/0016024 | A1 | 1/2013 | Shi et al. |

FOREIGN PATENT DOCUMENTS

| | | | |
|---|---|---|---|
| EP | 1122812 | A2 | 8/2001 |
| EP | 1750323 | A1 | 2/2007 |
| EP | 3285333 | A1 | 2/2018 |

(Continued)

OTHER PUBLICATIONS

Korean Office Action issued in corresponding application KR 10-2017-0177596, dated Nov. 28, 2018.

European Search Report for 16306768.9 dated Feb. 28, 2017.

*Primary Examiner* — Robert Karacsony

(74) *Attorney, Agent, or Firm* — Meagher Emanuel Laks Goldberg & Liao, LLP

(57) ABSTRACT

The invention discloses an antenna arrangement of a bonsai type, where not only the resonating frequencies may be adjusted, but also the bandwidth around some or all resonating frequencies. This is achieved by adding new branches to the trunk of the bonsai antenna arrangement. The positions and lengths of the branches are defined as a function of the frequencies around which the bandwidth should be adjusted. The antenna arrangement may be inscribed in a 3D compact volume of a specific form factor. It may also be inscribed in a planar structure. The antenna arrangement may be produced at a low cost. It may be used in a variety of applications, including communications in WiFi or other standards of multimedia content that need defined bandwidths for instance to comply to a predetermined quality of service.

15 Claims, 14 Drawing Sheets

(51) Int. Cl.
*H01Q 9/16* (2006.01)
*H01Q 1/44* (2006.01)

(56) References Cited

FOREIGN PATENT DOCUMENTS

| | | | |
|---|---|---|---|
| KR | 10-2009-0074849 | | 7/2009 |
| KR | 10-2014-0004732 | | 1/2014 |
| KR | 10-2014-0034932 | | 3/2014 |
| WO | 01/22528 | A1 | 3/2001 |
| WO | 03/034538 | A1 | 4/2003 |
| WO | 03/034544 | A1 | 4/2003 |

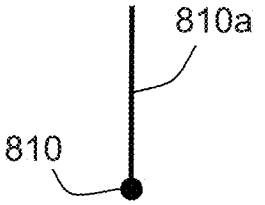
FIG.8a
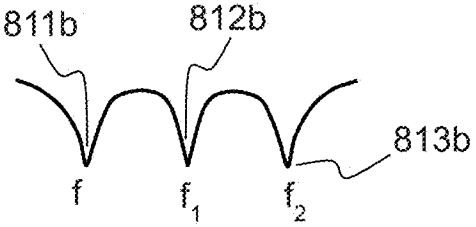
FIG.8b
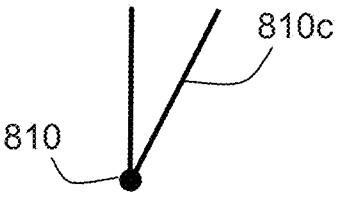
FIG.8c
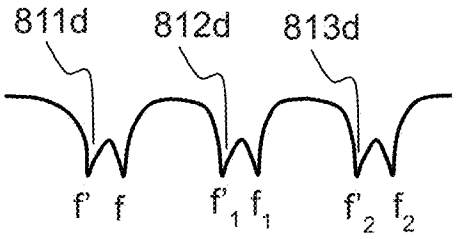
FIG.8d
FIG.8e
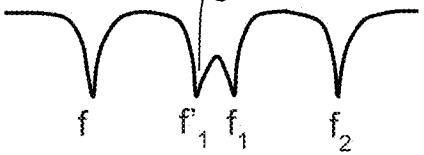
FIG.8f

| % ℓ \ f | f | $f_1$ | $f_2$ | $f_3$ | f | $f_1$ | $f_2$ | $f_3$ |
|---|---|---|---|---|---|---|---|---|
| 100 | ⊕ | ⊕ | ⊕ | ⊕ | 6 | 6 | 6 | 6 |
| 95 | ⊕ | ⊕ | ⊕ | ⊕ | 6 | 6 | 6 | 6 |
| 90 | ⊕ | ⊕ | ⊕○ | ○ | 6 | 6 | 5 | 3 |
| 85 | ⊕ | ⊕ | ○● | ● | 6 | 6 | 2 | 0 |
| 80 | ⊕ | ○ | ● | ○⊕ | 6 | 3 | 0 | 4 |
| 75 | ⊕ | ○● | ○● | ⊕ | 6 | 2 | 2 | 6 |
| 70 | ⊕ | ● | ⊕○ | ⊕ | 6 | 0 | 5 | 6 |
| 65 | ⊕ | ● | ⊕ | ⊕ | 6 | 0 | 6 | 6 |
| 60 | ⊕ | ●○ | ⊕ | ●○ | 6 | 1 | 6 | 1 |
| 55 | ⊕ | ○ | ⊕ | ● | 6 | 3 | 6 | 0 |
| 50 | ⊕ | ⊕ | ⊕○ | ⊕○ | 6 | 6 | 5 | 5 |
| 45 | ○ | ⊕ | ○● | ⊕ | 3 | 6 | 2 | 6 |
| 40 | ○ | ⊕ | ● | ⊕ | 3 | 6 | 0 | 6 |
| 35 | ○ | ⊕ | ○● | ○⊕ | 3 | 6 | 2 | 4 |
| 30 | ○ | ⊕ | ⊕○ | ● | 3 | 6 | 5 | 0 |
| 25 | ○ | ⊕ | ⊕ | ○● | 3 | 6 | 6 | 2 |
| 20 | ● | ⊕ | ⊕ | ⊕ | 0 | 6 | 6 | 6 |
| 15 | ● | ○⊕ | ⊕ | ⊕ | 0 | 4 | 6 | 6 |
| 10 | ● | ○ | ⊕○ | ⊕ | 0 | 3 | 5 | 6 |
| 5 | ● | ● | ○● | ○ | 0 | 0 | 2 | 3 |
| 0 | ● | ● | ● | ● | 0 | 0 | 0 | 0 |

12100 12110 12121 12122 12123 12200 12300

⊕=6 ⊕○=5 ○⊕=4 ○=3

○●=2 ●○=1 ●=0

FIG.12

| | | | | | | | |
|---|---|---|---|---|---|---|---|
| Adding a leaf at | 100%ℓ | ⇒ | Impact on | $f$ | $f_1$ | $f_2$ | $f_3$ |
| // | 85%ℓ | | | $f$ | $f_1$ | | |
| // | 75%ℓ | | | $f$ | | | $f_3$ |
| // | 60%ℓ | | | $f$ | | $f_2$ | |
| // | 40%ℓ | | | | $f_1$ | | $f_3$ |
| // | 25%ℓ | | | | $f_1$ | $f_2$ | |
| // | 20%ℓ | | | | $f_1$ | $f_2$ | $f_3$ |
| // | 12,5%ℓ | | | | | $f_2$ | $f_3$ |

FIG.13

CONFIGURABLE MULTIBAND ANTENNA ARRANGEMENT WITH WIDEBAND CAPACITY AND DESIGN METHOD THEREOF

FIELD OF THE INVENTION

The invention relates to antenna arrangements having a plurality of frequency modes in the VHF, UHF, S, C, X or higher frequency bands. More precisely, an antenna arrangement according to the invention may be designed and tuned in a simple manner to transmit/receive (T/R) radiofrequency signals at a plurality of frequencies with adjustable frequency bandwidths, notably in the microwave or VHF/UHF domains, with compact form factors.

BACKGROUND

Terminals or smartphones on board aircraft, ships, trains, trucks, cars, or carried by pedestrians need to be connected while on the move. These devices need short and very long range communication capabilities for voice and data at a high-throughput and a low power budget, including to watch or listen to multimedia content (video or audio), or participate in interactive games. All kinds of objects on-board vehicles or located in a manufacturing plant, an office, a warehouse, a storage facility, retail establishments, hospitals, sporting venues, or a home are connected to the Internet of Things (IoT): tags to locate and identify objects in an inventory or to keep people in or out of a restricted area; devices to monitor physical activity or health parameters of their users; sensors to capture environmental parameters (concentration of pollutants; hygrometry; wind speed, etc.); actuators to remotely control and command all kinds of appliances, or more generally, any type of electronic device that could be part of a command, control, communication and intelligence system, the system being for instance programmed to capture/process signals/data, transmit the same to another electronic device, or a server, process the data using processing logic implementing artificial intelligence or knowledge based reasoning and return information or activate commands to be implemented by actuators.

RF communications are more versatile than fixed-line communications for connecting these types of objects or platforms. As a consequence, radiofrequency T/R modules are and will be more and more pervasive in professional and consumer applications. A plurality of T/R modules may be implemented on the same device. By way of example, a smartphone typically includes a cellular communications T/R module, a Wi-Fi/Bluetooth T/R module, a receiver of satellite positioning signals (from a Global Navigation Satellite System or GNSS). WiFi, Bluetooth and 3 or 4G cellular communications are in the 2.5 GHz frequency band (S-band). GNSS receivers typically operate in the 1.5 GHz frequency band (L-band). RadioFrequency IDentification (RFID) tags operate in the 900 MHz frequency band (UHF) or lower. Near Field Communication (NFC) tags operate in the 13 MHz frequency band (HF) at a very short distance (about 10 cm).

It seems that a good compromise for IoT connections lies in VHF or UHF bands (30 to 300 MHz and 300 MHz to 3 GHz) to get sufficient available bandwidth and range, a good resilience to multipath reflections as well as a low-power budget.

A problem to be solved for the design of T/R modules at these frequency bands is to have antennas which are compact enough to fit in the form factor of a connected object.

A traditional omnidirectional antenna of a monopole type, adapted for VHF bands, has a length between 25 cm and 2.5 m ($\lambda/4$). A solution to this problem is notably provided by PCT application published under n° WO2015007746, which has the same inventor and is co-assigned to the applicant of this application. This application discloses an antenna arrangement of a bung type, where a plurality of antenna elements are combined so that the ratio between the largest dimension of the arrangement and the wavelength may be much lower than a tenth of a wavelength, even lower than a twentieth or, in some embodiments than a fiftieth of a wavelength. To achieve such a result, the antenna element which controls the fundamental mode of the antenna is wound up in a 3D form factor, such as, for example, a helicoid so that its outside dimensions are reduced relative to its length.

But there is also a need for the connected devices to be compatible with terminals which communicate using WiFi or Bluetooth frequency bands and protocols. In this use case, some stages of the T/R module have to be compatible with both VHF and S bands. If a GNSS receiver is added, a T/R capacity in L band is also needed. This means that the antenna arrangements of such devices should be able to communicate simultaneously or successively in different frequency bands. Adding as many antennas as frequency bands is costly in terms of form factor, power budget and materials. This creates another challenging problem for the design of the antenna. Some solutions are disclosed for base station antennas by PCT applications published under n° WO200122528 and WO200334544. But these solutions do not operate in VHF bands and do not provide arrangements which would be compact enough in these bands.

The applicant of this application has filed a European patent application under n° EP2016/306059.3 that has the same inventor as this application. This application discloses an antenna arrangement comprising: a first conductive element configured to radiate above a defined frequency of electromagnetic radiation; one or more additional conductive elements located at or near one or more positions defined as a function of positions of nodes of current (i.e. zero current or Open Circuit positions) of harmonics of the electromagnetic radiation.

This earlier application does not disclose how to adjust the frequency bandwidths around the defined frequency of electromagnetic radiation or its harmonics. It would be desirable to control these frequency bandwidths so as to be able to ensure a defined throughput, or to meet the performance requirements of various standards for radiocommunication such as IEEE 802.11, 802.15.4 etc., for instance for transmitting multimedia contents with a defined quality of service. The instant invention discloses a solution to this problem.

SUMMARY OF THE INVENTION

The invention fulfils this need by providing an antenna arrangement comprising a first main conductive element and at least an antenna element tuned to a lower frequency of a fundamental mode (first order harmonic) and additional elements whose position, form factor, dimension and orientation are determined to optimize the conditions of transmission or reception of selected harmonics of this fundamental mode, wherein the antenna arrangement further comprises at least a second main conductive element configured to form with at least parts of the antenna arrangement a resonating structure of an order higher than one around a frequency of one of the selected harmonics of the fundamental mode of the first main conductive element, the second main conductive element having a feed connection located at, or close to, a belly of current (i.e. a maximum of current or Short Circuit position) of the first main conductive element.

More specifically, the invention discloses an antenna arrangement comprising: a first main conductive element configured to radiate above a defined frequency of electromagnetic radiation; one or more first secondary conductive elements located at or near one or more positions defined on the first main conductive element as a function of positions of nodes of current of electromagnetic radiation of selected harmonics of the electromagnetic radiation; at least a second main conductive element: configured to form with at least parts of the antenna arrangement a resonating structure of an order higher than one at a frequency of one of the selected harmonics of the electromagnetic radiation; and having a feed connection located at or near a position on another main conductive element that is defined as a function of positions of bellies of current of one of the selected harmonics of the electromagnetic radiation.

Advantageously, the resonating structure of an order higher than one is matched at or above a predefined level across bandwidth defined around the frequency of one of the selected harmonics of the electromagnetic radiation.

Advantageously, the at least a second main conductive element comprises one or more second secondary conductive elements located at or near one or more positions defined on the second main conductive element as a function of positions of nodes of electromagnetic radiation of the one of the harmonics of the electromagnetic radiation.

Advantageously, the at least a second main conductive element has a total electrical length that is defined as function of an odd integer multiple of a quarter of a wavelength at the frequency of the one of the harmonics of the electromagnetic radiation.

Advantageously, the bandwidth is equal to or larger than a predefined percentage value of the frequency of the one of the selected harmonics of the electromagnetic radiation across which the antenna arrangement is adapted.

Advantageously, the antenna arrangement is adapted across the bandwidth surrounding the frequency of the one of the selected harmonics of the electromagnetic radiation at a level equal to or greater than an absolute predefined value.

Advantageously, one or more of the first main conductive elements or the second main conductive elements are a metallic ribbon and/or a metallic wire.

Advantageously, one or more of the first main conductive elements and the second main conductive element has one of a 2D or 3D compact form factor.

Advantageously, the antenna arrangement of the invention is deposited by a metallization process on a non-conductive substrate layered with one of a polymer, a ceramic or a paper substrate.

Advantageously, the antenna arrangement of the invention is tuned to radiate in two or more frequency bands, comprising one or more of an ISM band, a WiFi band, a Bluetooth band, a 3G band, a LTE band and a 5G band.

The invention also discloses a method of designing an antenna arrangement comprising: defining a geometry of a first main conductive element to radiate above a defined frequency of electromagnetic radiation; locating one or more first secondary conductive elements at or near one or more positions defined as a function of positions of nodes of current of electromagnetic radiation of selected harmonics of the electromagnetic radiation; defining a total electrical length or a frequency of a fundamental mode of at least a second main conductive element to form with at least parts of the antenna arrangement a resonating structure of an order higher than one configured to resonate at a frequency of one of the selected harmonics of the electromagnetic radiation; locating a feed connection of the at least a second main conductive element at or near a position on another main conductive element that is defined as a function of positions of bellies of current of electromagnetic radiation of the one of the selected harmonics of the electromagnetic radiation.

Advantageously, the resonating structure of an order higher than one is matched at a level equal to or greater than a predefined level across the bandwidth defined around the frequency of one of the selected harmonics of the electromagnetic radiation.

Advantageously, the method of the invention further comprises locating one or more second secondary conductive elements at or near one or more positions defined on the second main conductive element as a function of positions of nodes of current of one of the harmonics of the electromagnetic radiation.

Advantageously, the method of the invention further comprises: i) defining a total electrical length or a frequency of a fundamental mode of at least an additional main conductive element to form with at least parts of the antenna arrangement a resonating structure of an order higher than one configured to resonate at a frequency of one of the selected harmonics of the electromagnetic radiation, the total electrical length and the selected harmonics being determined as functions of a length of the additional main conductive element and of orientation, main dimension and form factor of the secondary conductive elements positioned on the additional main conductive element; ii) locating a feed connection of the additional main conductive element at or close to a position on another main conductive element that is defined as a function of positions of bellies of current of electromagnetic radiation of the another one of the harmonics of the electromagnetic radiation; iii) iterating until predefined levels of matching are achieved across target bandwidths around a number of frequencies are achieved, subject to preserving previously controlled frequencies, bandwidths and matching levels.

The invention also discloses an antenna arrangement comprising: a first main conductive element configured to radiate above a defined frequency of electromagnetic radiation; one or more secondary conductive elements located at or near one or more positions defined on the first main conductive element as a function of positions of nodes of current of electromagnetic radiation of harmonics of the electromagnetic radiation; at least a second main conductive element (211) having a total electrical length that is adapted to enlarge a frequency band around a frequency of one or more selected harmonics of the electromagnetic radiation so as to transmit/receive RF signals at or above a predefined quality of service.

The multi-frequency wideband antenna arrangement of the invention may be compact, allowing its integration in small volumes.

The antenna arrangement of the invention is simple to design, notably when tuning the radiating frequencies and the corresponding frequency bandwidths to desired values, taking into account the impact of the environment of the antenna arrangement, notably the ground plane, the position of the main trunk of the antenna and elements of the environment that have an electromagnetic impact on its electrical performance.

The antenna arrangement of the invention is easy to manufacture and thus has a very low cost.

Also, the antenna arrangement of the invention is very easy to connect either in an orthogonal configuration or in a coplanar configuration to a RF Printed Circuit Board (PCB).

BRIEF DESCRIPTION OF THE DRAWINGS

The invention and its advantages will be better understood upon reading the following detailed description of a particular embodiment, given purely by way of non-limiting example, this description being made with reference to the accompanying drawings in which:

FIGS. 8*a* and 8*b* respectively represent a schematic of an antenna arrangement of the prior art with a monopole antenna element and its frequency response;

FIGS. 8*c*, 8*e*, 8*g* and 8*i* represent schematics of antenna arrangements with two "monopole" antenna elements according to a plurality of embodiments of the invention;

FIGS. 8*d*, 8*f*, 8*h* and 8*j* represent the frequency responses of the antenna arrangements respectively of FIGS. 8*c*, 8*e*, 8*g* and 8*i;*

FIG. 12 represents a table of electric sensitivities along the antenna in the fundamental mode and the $1^{st}$ to $3^{rd}$ higher order modes for an antenna arrangement according to the prior art;

FIG. 13 represents a table to assist in the selection of the positioning of the leaves to adjust the values of some frequencies selected among the fundamental mode and the $1^{st}$ to $3^{rd}$ higher order modes for an antenna arrangement according to the prior art;

DETAILED DESCRIPTION

Figure 1A:
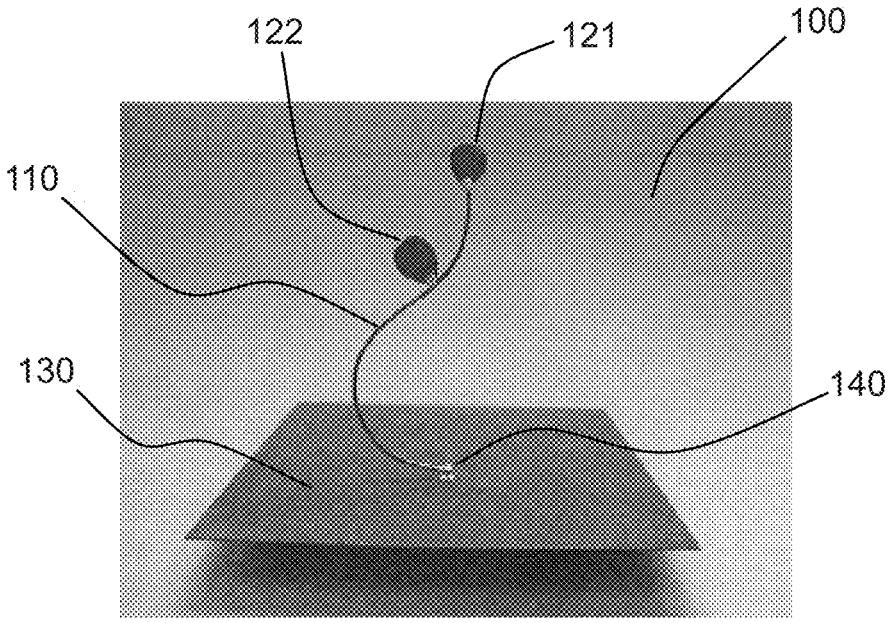
PRIOR ART FIG.1a
FIGS. 1*a* and 1*b* respectively represent an antenna arrangement according to the prior art and its frequency response.
Figure 1B:
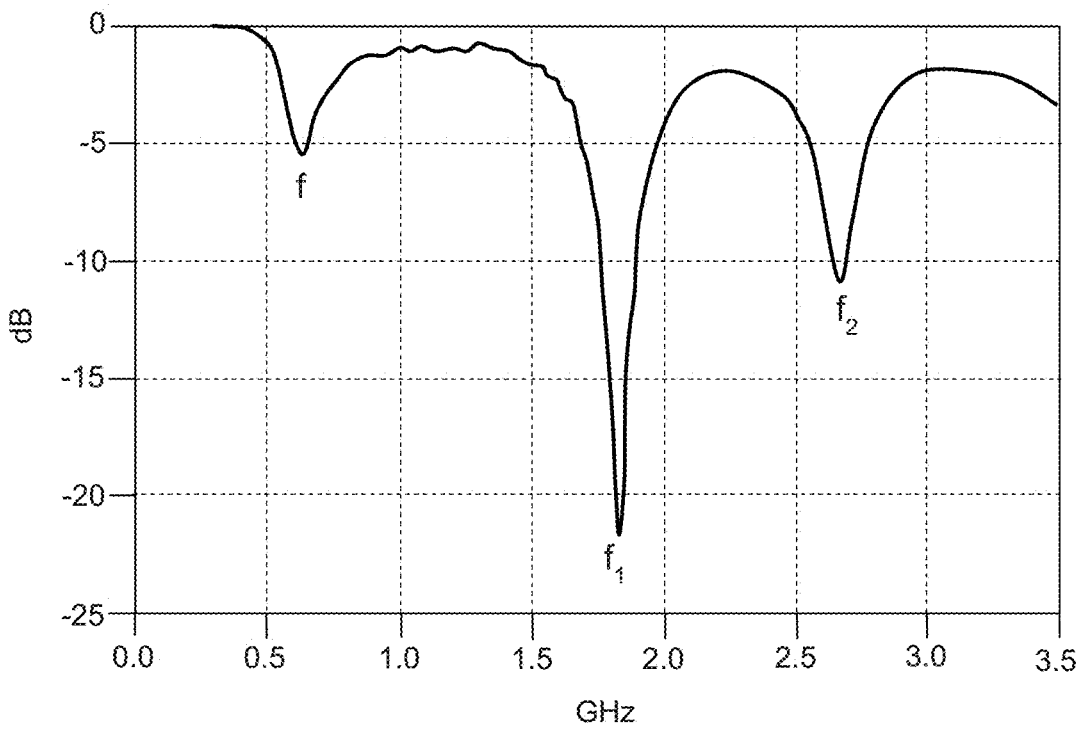

FIGS. 1*a* and 1*b* respectively represent an antenna arrangement according to the prior art and its frequency response.

The antenna arrangement 100 is a monopole antenna with an omnidirectional radiating pattern in the azimuth plane.

The structure of the antenna arrangement 100 according to embodiments disclosed in European patent application under n° EP2016/306059.3 is analogous to a compact tree structure that in some aspects resembles the structure of a bonsai. The dimensions of this arrangement are selected so that the antenna is fit to operate in the ISM (Industrial, Scientific, Medical), VHF and UHF bands. The tree comprises a trunk 110, leaves 121, 122. The tree is planted on a ground plane 130.

The trunk 110 is formed of a conductive material, metallic wire or ribbon, with a deployed length l which is defined as a function of the desired radiating frequency of the fundamental mode as explained further down in the description. The trunk may be inscribed in a plane. In some embodiments, the plane in which the trunk is inscribed may be parallel to the ground plane, or may be inscribed in the ground plane in a solution where the antenna and the ground plane are designed as a coplanar arrangement. In such an arrangement, the antenna may be engraved on a face of the substrate and the ground plane may be engraved on the backplane of the substrate. In other embodiments like the one depicted on FIG. 1*a*, the plane in which the trunk is inscribed is perpendicular to the ground plane. The trunk may alternatively be inscribed in a non-planar surface or a volume structure. Such a form factor is advantageous to increase the compactness of an antenna arrangement of a given length l.

The leaves 121, 122 are also formed of a metal and mechanically and electrically connected to the trunk at defined points, as discussed further down in the description. The leaves may be seen as structures extending the length of the antenna of a defined amount in defined directions. The leaves may thus have different positions, form factors, dimensions and orientations in space. They may be inscribed together in a same plane or different surfaces or not. They may be coplanar with the trunk or not. The selected positions, form factors, dimensions and orientations will affect the variation in radiating frequencies (i.e. fundamental and higher order modes) imparted to the base frequencies defined by the length of the trunk.

The different radiating modes are basically defined by the length of the radiating pole element:

- The fundamental mode is defined by a length l of the radiating element which is equal to $\lambda/4$ (first harmonic);
- The $1^{st}$ higher order mode is defined by a length $l_1$ of the radiating element which is equal to $3\lambda/4$ (third harmonic);
- The $2^{nd}$ higher order mode is defined by a length $l_2$ of the radiating element which is equal to $5\lambda/4$ (fifth harmonic);
- The $3^{rd}$ higher order mode is defined by a length $l_3$ of the radiating element which is equal to $7\lambda/4$ (seventh harmonic).

where $\lambda=c/f$, f being the radiating frequency at the fundamental mode.

The ground plane 130 is the metallic backplane of a PCB structure which comprises the excitation circuits which feed the RF signal to the trunk at their point of mechanical and electrical connection 140.

FIG. 1*b* represents the frequency response of the antenna arrangement of FIG. 1*a*. The abscise axis displays the values of the frequencies of the electromagnetic radiation and the ordinate axis the values of their matching level. Frequency f is the first harmonic or fundamental mode of the electromagnetic radiation, frequency $f_1$ is its third harmonic or first higher mode and frequency $f_2$ is its fifth harmonic or second higher mode. These frequency values are tuned by using leaves connected to the trunk as displayed on FIG. 1*a*.

Figure 2A:
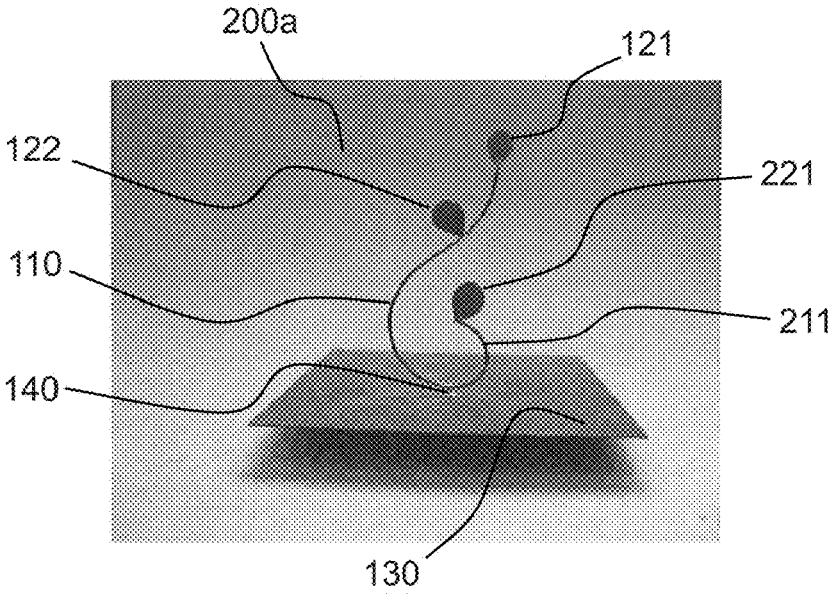
FIGS. 2*a*, 2*b* and 2*c* display prototypes of antenna arrangements according to different embodiments of the invention.
Figure 2B:
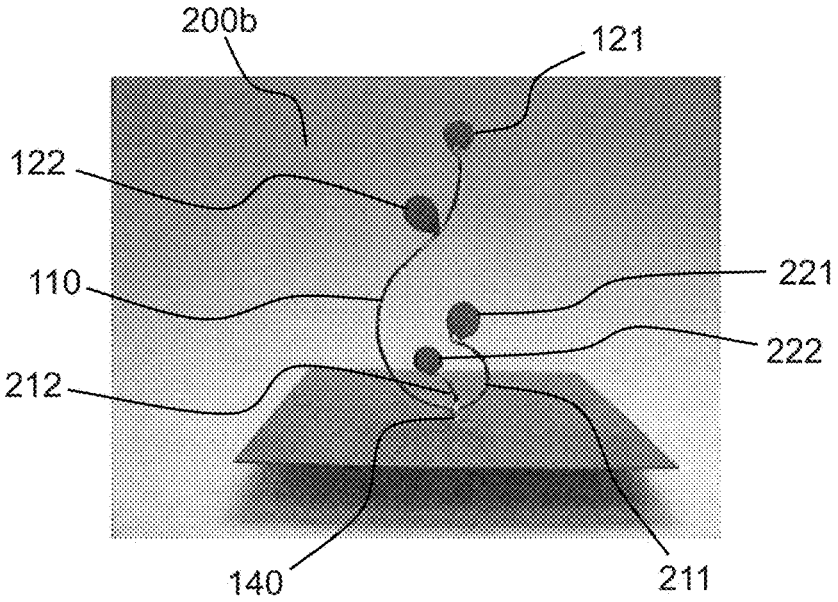
Figure 2C:
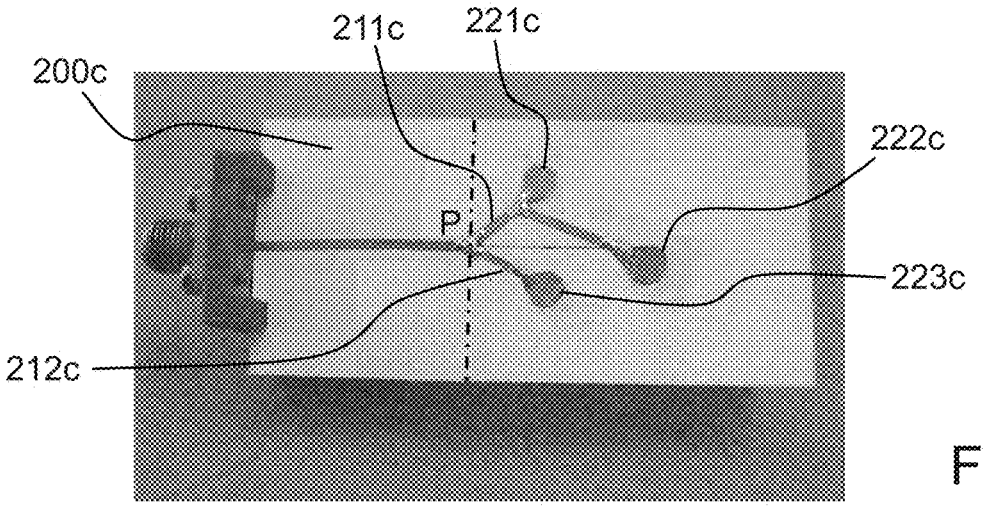

FIGS. 2*a*, 2*b* and 2*c* display prototypes of antenna arrangements according to different embodiments of the invention.

The antenna arrangement 200*a* of FIG. 2*a* may be designed starting from the antenna arrangement 100 of FIG. 1*a*, with its trunk 110 connected to the feed line 140 at the ground plane 130. The trunk is a monopole antenna. The trunk bears two leaves 121, 122 thus defining a multi-resonator at a plurality of frequencies $f_i$ that are defined starting by the fundamental mode f so that the total electrical length of the trunk, including its leaves, equals one quarter of the wavelength at this frequency. According to the disclosure of EP2016/306059.3, the leaves 121, 122 are positioned at "Hot Spots" (or Open Circuit positions) along the trunk, the Hot Spots being defined at locations on the radiating pole where the electric current in the pole is minimal or the voltage is maximal. Adding a leaf at one of the Hot Spots for a mode (fundamental or higher order) shifts the radiating frequency to a lower value for this mode. Thus, the frequencies of the fundamental and higher order modes that are in a mathematical relationship may be used to create radiating frequencies of a desired value.

According to a first aspect of the invention, a first branch 211 (or second main conductive element, the trunk being defined as the first main conductive element) is added to the trunk at position 140 which is a "Cold Spot" for all modes (Short Circuit position). Conversely to Hot Spots, Cold Spots are defined by the disclosure of EP2016/306059.3 as locations on the radiating pole where the electric current in the pole is maximal or the voltage is minimal. Adding a radiating element at a Cold Spot will not modify the radiating properties of the trunk. A leaf 221 is added to the branch 211. The total electric length l' of the branch 211 plus the leaf 221 is selected so that the radiating frequency $f'_i$ of this element is determined as a function of one of the radiating frequencies $f_i$ of a mode of the trunk: $l'_i \approx c/4f_i$ where c is the speed of light in vacuum.

According to this aspect of the invention, the radiating frequency $f'_i$ of the second main conductive element 211 is determined so that the second main conductive element forms a second order resonating structure (or second order filter) with the first main conductive element 110 around a frequency $f_i$ of one of its selected harmonics. The bandwidth around $f_i$ is thus enlarged by this double resonator circuit as will be discussed with further details in relation to FIGS. 3, 4 and 5.

According to the invention, the following rules should be applied by a designer of the antenna arrangement to determine the frequency $f'_i$ as a function of the frequency $f_i$:

A target bandwidth is first defined, possibly by the functional specification of the antenna arrangement; the inventor has demonstrated experimentally that it was possible to achieve a target bandwidth of about 20% of the value of frequency $f_i$; more generally, it is possible to set a predefined percentage of frequency $f_i$ that the target bandwidth should cover above and underneath frequency $f_i$; in some use cases, it may be possible to cover target bandwidths of 25%, 30% of $f_i$ or even more;

A target matching level across the target bandwidth is then defined, possibly by the technical specification of the feeding circuit of the antenna arrangement; a level of −10 dB is customary for a standard matching impedance of 50Ω; but other matching levels may be used, depending on the design constraints adapted to the application; a parameter value may be defined to set the design constraints that will be applicable to the antenna arrangement; in some applications −5 dB may be acceptable, whereas in some others, −15 dB will be mandatory.

The higher the target matching level, the lower the actual bandwidth will be.

Based on these rules, the precise determination of $f'_i$ may be achieved either by simulation or experimentally, so as to achieve the best possible compromise between the target bandwidth and the target matching level across the target bandwidth.

According to a further aspect of the invention illustrated on FIG. 2*b*, a second branch 212 may be added to the trunk. The addition is also made at the connection to the feed line 140, which is, as already explained, a Cold Spot for all modes. Thus, the radiating properties of the trunk and of the first added branch 211 will not be modified (or slightly only). A leaf 222 is added to the second branch 212. The total electric length of the branch 212 plus the leaf 222 is selected so that the radiating frequency $f'_j$ of this element be close to one of the radiating frequencies $f_j$ of a mode of the trunk. The technical effect of the second order resonating structure that is thereby created around frequency $f_j$ is the same as the one discussed above for the first branch.

According to these aspects of the invention, when an antenna arrangement comprising a trunk and leaves has radiating frequencies $f_i$, $f_j$, adding branches of lengths $l'_i$, $l'_j$ defined as explained above, at positions that are Cold Spots for both frequencies will create defined bandwidths around $f_i$, $f_j$.

The antenna arrangements of FIGS. 2*a* and 2*b* are formed with metal wires and metal leaves. The wires forming the trunk and branches may be replaced by metal ribbons. The trunk and branches may have totally different form factors. For instance, the trunk may be a helicoidal 3D structure. This may be advantageous in the case of long wavelengths/low frequencies. Placing the branches will then require some care so as to avoid electric coupling as much as possible (i.e. it will be necessary to maintain a minimum distance between the different elements of the antenna arrangement). The leaves of the exemplary structures of FIGS. 2*a* and 2*b* are coplanar with the trunk and branches. But other arrangements may be contemplated, especially when the trunk and branches have 3D form factors.

FIG. 2*c* illustrates an embodiment of a 2D antenna arrangement 200*c* according to the invention that has a trunk 211*c*, two leaves 221*c*, 222*c* on this trunk, a branch 212*c*, connected to the trunk at the point P where the connection to the feeding line is made, with a leaf 223*c*. The trunk, branch and leaves may be manufactured by a printing process on a paper substrate, but the substrate may also be rigid or flexible, as is the case for a polymer or ceramic substrate. The substrate may also be in any other non-conductive material. Printing may be performed by prior metallisation and further etching of the substrate, or by selective printing of the substrate. The ground plane is implanted on the back face of the substrate by the same process.

Figure 3:
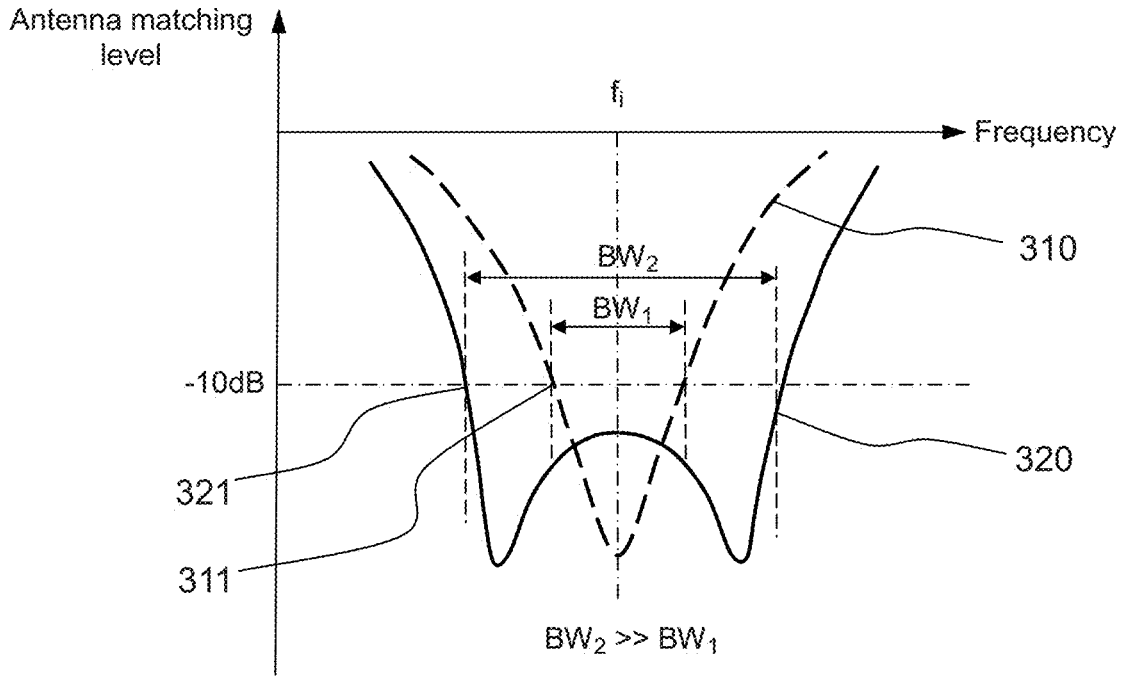
FIG. 3 illustrates the theoretical frequency responses of an antenna arrangement of the prior art and of an antenna arrangement according to some embodiments of the invention.

FIG. 3 illustrates the theoretical frequency responses of an antenna arrangement of the prior art and of an antenna arrangement according to some embodiments of the invention.

The abscise of the graph of FIG. 3 is the frequency (for instance in GHz) of the signal radiated by an antenna arrangement. The ordinate is the matching level in dB of the antenna arrangement. The curve 310 illustrates the frequency response of an antenna arrangement of the prior art, i.e. with a single resonating frequency, such as the one of FIG. 1*a*, while curve 320 illustrates the frequency response of an antenna arrangement with a double resonator structure, such as the one of FIG. 2*a*.

The bandwidth BW1, 311, of the first arrangement is defined for instance for a matching level of −10 dB. At the same matching level, BW2, 321, of the second arrangement is much larger because the frequency response is enlarged by the double resonator structure.

Increasing the order of the resonator structure would again enlarge the bandwidth as now illustrated.

Figure 3A:
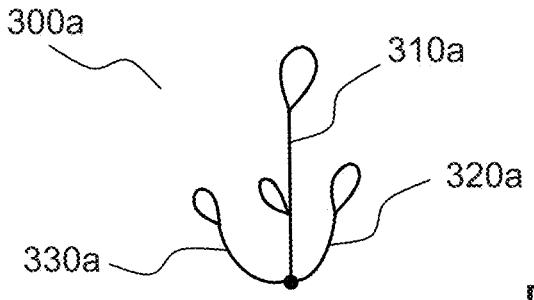
FIGS. 3*a* and 3*b* respectively illustrate an antenna arrangement forming a third order resonating structure at the first order higher mode and its frequency response.
Figure 3B:
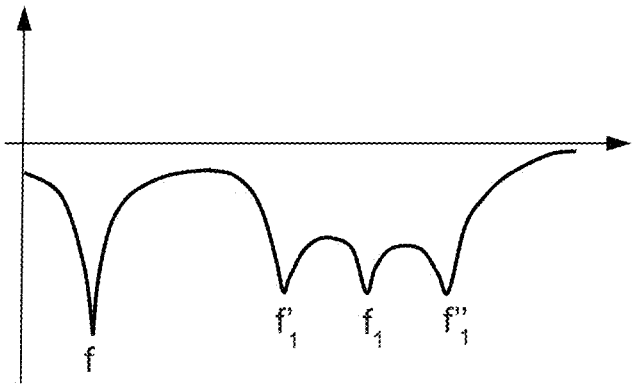

FIGS. 3*a* and 3*b* respectively illustrate an antenna arrangement forming a third order resonating structure at the first order mode and its frequency response.

The antenna arrangement 300*a* of FIG. 3*a* has a trunk 310*a* (first main conductive element), a first branch 320*a* (second main conductive element) and a third branch 330*a* (third main conductive element).

The radiating frequencies of the first higher order mode, $f_1$, $f'_1$ and $f'_1$ are selected so that the radiating structure forms a third order resonator as can be seen on FIG. 3*b*.

The rules that the designer of the antenna arrangement should apply are similar to those explained above in relation with the design of a second order resonator: find the best compromise between the target bandwidth (from $f'_1$ to $f'_1$) and the target matching level.

It is possible to generalize this approach by designing an antenna arrangement organized as a k-order resonating structure with a first main conductive element and (k−1) other main conductive elements, the conductive elements being configured to cover the target bandwidth at the target matching level.

Figure 4:
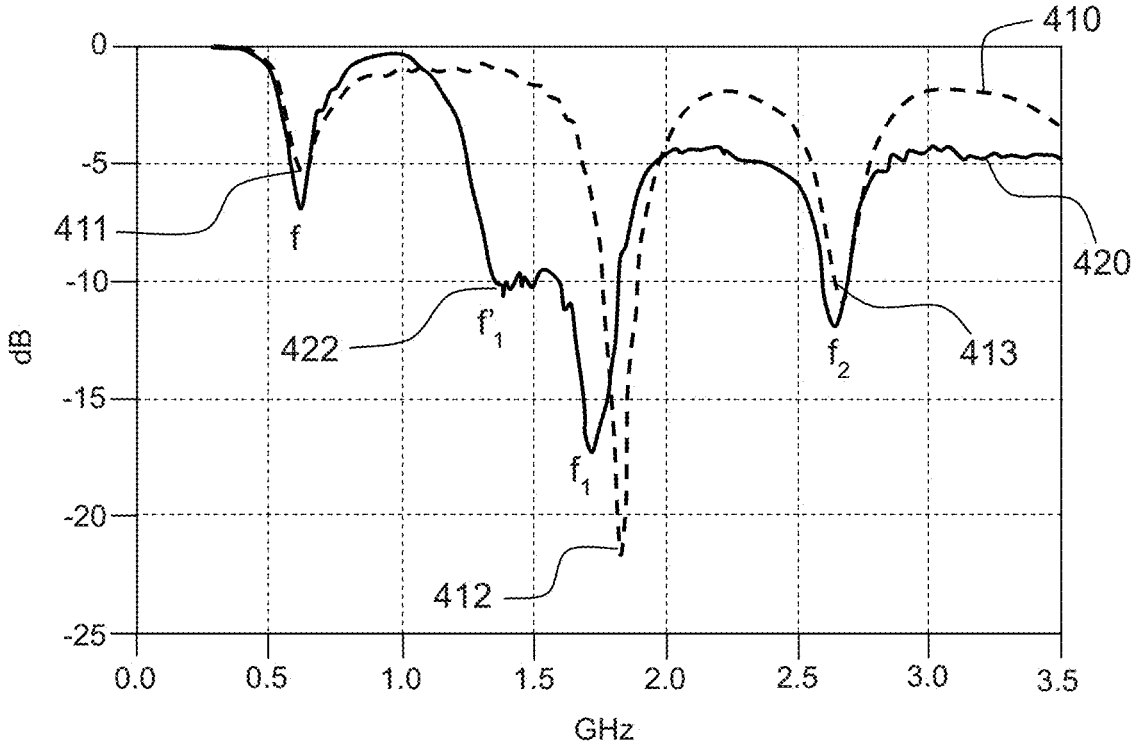
FIG. 4 illustrates the experimental frequency responses of the antenna arrangements of FIGS. 1*a* and 2*a;*

FIG. 4 illustrates the experimental frequency responses of the antenna arrangements of FIGS. 1*a* and 2*a*.

The curve 410 illustrates the frequency response of the antenna arrangement of FIG. 1*a* that is an arrangement of single resonators at three different resonating frequencies f, 411, $f_1$, 412 and $f_2$, 413. In this exemplary embodiment, f=0.6 GHz, $f_1$=1.8 GHz and $f_2$=2.65 GHz.

The curve 420 illustrates the frequency response of the antenna arrangement 200*a* of FIG. 2*a*. The length of the branch 211 and the leaf 221 has been selected to define a frequency $f_1$ 422 that is not too far from $f_1$. In this case $f_1$=1.35 GHz, i.e. 0.45 GHz below $f_1$. The bandwidth at a matching level of −10 dB goes from 1.3 GHz to 1.8 GHz, whereas the bandwidth of the antenna arrangement 100 of FIG. 1*a* is 1.75-1.9 GHz for frequency $f_1$ at the same −10 dB matching level. This example clearly demonstrates the technical effect of the branch added to the trunk, the available bandwidth around the target frequency increasing from 0.15 GHz to 0.5 GHz.

Figure 5:
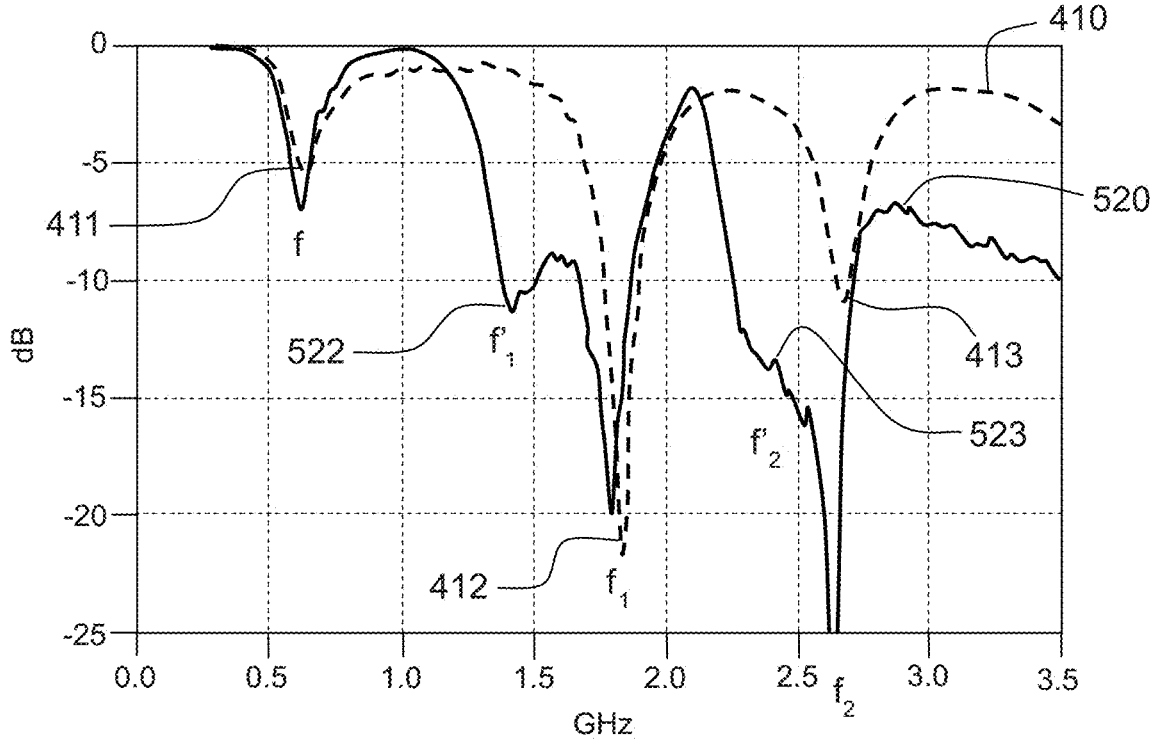
FIG. 5 illustrates the experimental frequency responses of the antenna arrangements of FIGS. 1*a* and 2*b;*

FIG. 5 illustrates the experimental frequency responses of the antenna arrangements of FIGS. 1*a* and 2*b*.

The curve 410 of FIG. 4 is reproduced on FIG. 5 with the same reference numerals. It shows the same three frequencies f, 411, $f_1$, 412 and $f_2$, 413 of the single resonators.

The curve 520 illustrates the frequency response of the antenna arrangement 200*b* of FIG. 2*b*. The length of the branch 212 and the leaf 222 has been selected to define a frequency $f'_2$, 523, that is not too far from $f_2$. In this case $f'_2$=2.35 GHz, i.e. 0.30 GHz below $f_2$. The bandwidth for this frequency at a matching level of −10 dB goes from 2.2 GHz to 2.65 GHz, whereas the bandwidth of the antenna arrangement 100 of FIG. 1*a* is less than 0.1 GHz at the same −10 dB matching level. It is also to be noted that the bandwidth at frequency $f_1$, 412, 522, is basically unaffected.

Figure 6:
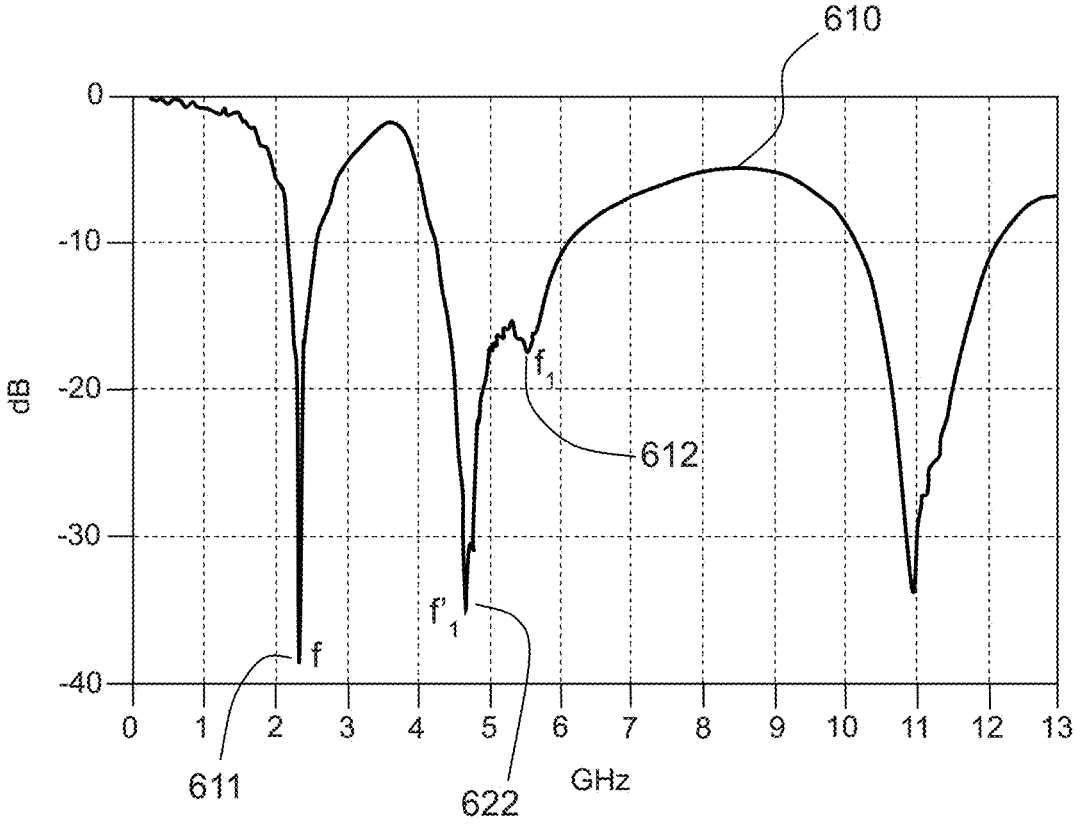
FIG. 6 illustrates the experimental frequency response of the antenna arrangement of FIG. 2*c;*

FIG. 6 illustrates the experimental frequency response of the antenna arrangement of FIG. 2*c*.

The curve 610 illustrates the frequency response. This antenna arrangement is a dual band Wi-Fi antenna with a first frequency f, 611, of 2.45 GHz and a second frequency $f_1$, 612, of 5.5 GHz. Thanks to the branch 212*c* and the leaf 223*c* added to the antenna arrangement that creates a double resonator, with a second frequency $f'_1$, 622, of about 4.75 GHz, the bandwidth around $f_1$ at −10 dB goes from 4.3 to 6 GHz (1.7 GHz), whereas the bandwidth around f is only of about 0.4 GHz.

Figure 7C:
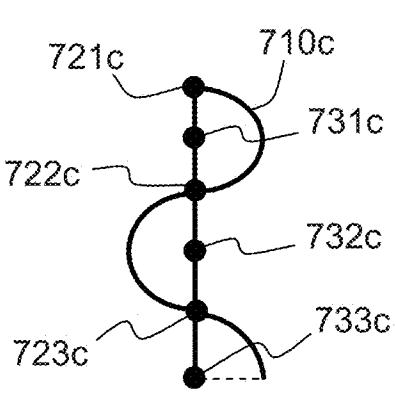
FIGS. 7*a*, 7*b* and 7*c* illustrate the positioning of hot spots and cold spots of harmonics in a monopole antenna of the prior art.
Figure 7B:
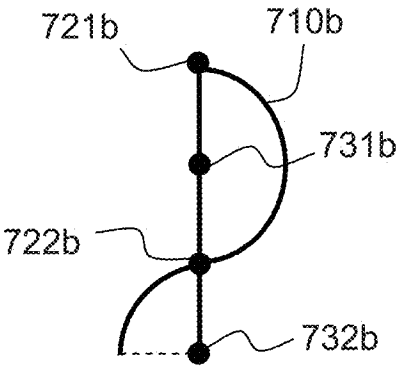
Figure 7A:
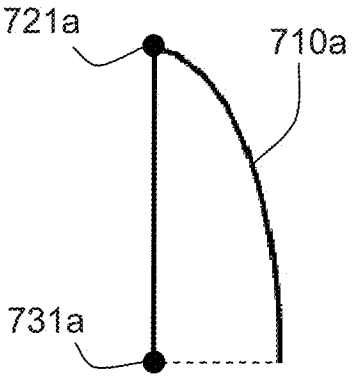
FIG.7a PRIOR ART

FIGS. 7*a*, 7*b* and 7*c* illustrate the positioning of hot spots and cold spots of harmonics in a monopole antenna of the prior art.

As disclosed by EP2016/306059.3 for each radiating mode of a bonsai antenna, there exists all along the trunk of the antenna, a map of electrical currents (dually voltages) associated with this mode. This map displays Cold Spots (that are equivalent for this mode to Short Circuits or maxima of current) and Hot Spots (that are equivalent for this mode to Open Circuits or maxima of voltage). Hot Spots allow a large shift of frequency for the mode by adding a leaf on the spot, whereas adding a leaf at a Cold Spot will not change the radiating frequency of the mode. This difference between Hot Spots and Cold Spots is illustrated by FIGS. 7*a*, 7*b* and 7*c*.

As displayed on FIG. 7*a*, in the fundamental mode, the distribution of current is represented by curve 710*a*. There is only one Hot Spot 721*a* and one Cold Spot 731*a*.

As displayed on FIG. 7*b*, in the first higher order mode corresponding to the third harmonics of the fundamental mode, the distribution of current is represented by curve 710*b*. There are two Hot Spots 721*b* and 722*b* and two Cold Spots 731*b* and 732*b*.

As displayed on FIG. 7*c*, in the second higher order mode corresponding to the fifth harmonics of the fundamental mode, the distribution of current is represented by curve 710*c*. There are three Hot Spots 721*c*, 722*c* and 723*c*, and three Cold Spots 731*c*, 732*c* and 733*c*.

It can be seen that the Hot Spots 721*c*, 722*c*, 723*c* are located at the zero crossing points of the curve 710*c* that displayed the distribution of the current along the pole. Adding a leaf located at one of these Hot Spots will shift the radiating frequency to a lower value. Conversely, the Cold Spots 731*c*, 732*c*, 733*c* are located at the maximum values of current on curve 710*c*. For the fundamental mode, there is only one Hot Spot and one Cold Spot. For the first higher order mode (third harmonic with k=1 in the order numbering 2k+1), there are 2 Hot Spots and two Cold Spots, i.e. there are k+1 Hot Spots and k+1 Cold Spots. Hot Spots and Cold Spots alternate along the pole. For k=1, the distance between a Hot Spot and the neighbour Cold Spot equals one quarter of the harmonics wavelength or one twelfth of the base wavelength or $\lambda/4(2k+1)$ or $l/(2k+1)$. The distance between a Hot Spot and the next closest Hot Spot equals two thirds of the length of the pole or one sixth of the base wavelength or $\lambda/2(2k+1)$ or $2l/(2k+1)$. These rules can be generalized for higher order modes k=2, 3, etc. corresponding to the $5^{th}$, $7^{th}$ harmonics, etc. The second order mode corresponding to the $5^{th}$ harmonics has 3 Hot Spots and 3 Cold Spots, two consecutive Hot Spots being spaced of 2l/5. The third order mode corresponding to the $7^{th}$ harmonics has 4 Hot Spots and 4 Cold Spots, two consecutive Hot Spots being spaced of 2l/7.

These rules allow placing the leaves on a trunk or branch of a bonsai antenna arrangement to either maximize or minimize the shift in frequency in relation to the base frequency of the corresponding mode.

According to the instant invention, similar rules are applied to determine the location of the points of connection of branches added to the trunk to enlarge the bandwidth, as described below in relation with the figures which follow.

FIGS. 8*a* and 8*b* respectively represent a schematic of an antenna arrangement of the prior art with a monopole antenna element and its frequency response.

On FIG. 8*a*, is displayed a monopole antenna 810*a* of length l, resonating at frequencies f, $f_1$ and $f_2$. This monopole antenna 810*a* is to be considered to be a trunk of a bonsai antenna arrangement. Leaves may be added to the trunk to adjust the resonating frequencies of the antenna arrangement. In the embodiment displayed on the figure, no leaves are added.

The electric response of the antenna is schematically represented on FIG. 8*b*, with the three resonating frequencies, f, $f_1$ and $f_2$, respectively 811*b*, 812*b* and 813*b*. The antenna arrangement is to be seen as a first order resonating structure at each of the three frequencies f, $f_1$, $f_2$.

FIGS. 8*c*, 8*e*, 8*g* and 8*i* represent schematics of antenna arrangements with two "monopole" antenna elements according to a plurality of embodiments of the invention.

As previously explained, the expression "monopole" antenna used here is justified by the fact that the resonating structure has a radiating diagram that is omnidirectional in azimuth.

On FIG. 8*c*, a branch 810*c* of length l' has been added to the trunk at the Cold Spot 810. In the example displayed on this FIG. 8*c*, the Cold Spot is the Short Circuit spot that is cold for all the resonating modes of the trunk. l' is defined by f', that in turn should be defined as a function of the target bandwidth around f and the target matching level across the target bandwidth, as previously explained. In this example, l' is a bit higher than l and f' is thus a bit lower than f.

Figure 8H:
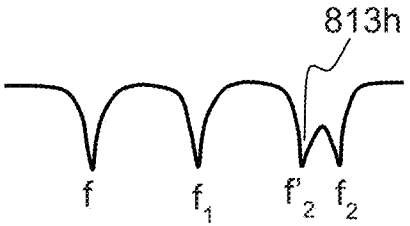
Figure 8J:
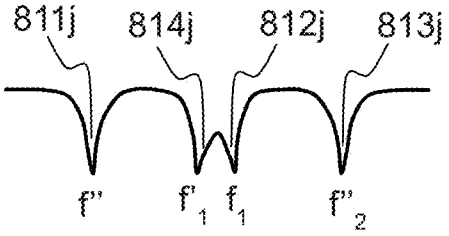
Figure 8K:
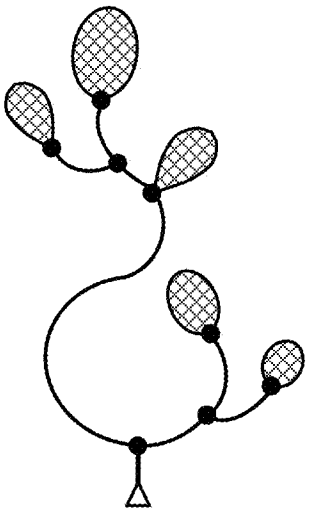
FIG. 8*k* represents an example of an embodiment of the invention where further branches are added to previous branches.
Figure 8G:
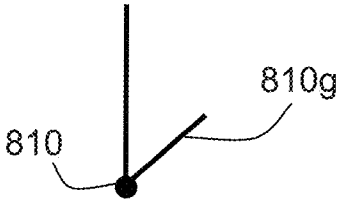

Similar design rules with different target frequencies are applied to obtain the schematic antenna arrangements of FIGS. 8*e* and 8*g*.

On FIG. 8*e*, a branch 810*e* of length l' a bit higher than l/3 has been added to the trunk at the Cold Spot 810 that is the Short Circuit spot, that is cold for all the resonating modes of the antenna arrangement. The branch will resonate at a frequency $f'_1$ that is a bit lower than $f_1$.

On FIG. 8*g*, a branch 810*g* of length l' a bit higher than l/5 has been added to the trunk at the Cold Spot 810 that is the Short Circuit spot, that is cold for all the resonating modes of the antenna arrangement. The branch will resonate at a frequency $f'_2$ that is a bit lower than $f_2$.

Figure 8I:
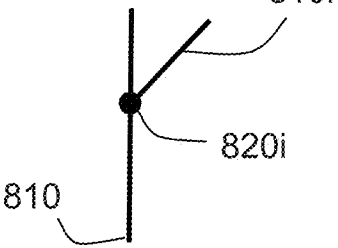

On FIG. 8*i*, a branch 810*i* of length l' a bit higher than l/3 has been added to the trunk at a Cold Spot 820*i* that is located at a distance of two thirds of l from the Short Circuit spot 810. This Cold Spot is only cold for frequency $f_1$. Therefore, the addition of the branch will change the resonating frequencies f and $f_2$ of the trunk, while it will not change the resonating frequency $f_1$.

FIGS. 8*d*, 8*f*, 8*h* and 8*j* represent the frequency responses of the antenna arrangements respectively of FIGS. 8*c*, 8*e*, 8*g* and 8*i*.

As the length of the branch 810*c* is higher than the length l of the trunk, all modes of the antenna arrangement are affected. As can be seen on FIG. 8*d*, three additional resonating frequencies 811*d*, 812*d* and 813*d* are created close to the resonating frequencies 811*b*, 812*b* and 813*b* of the trunk. This is because this branch will resonate at frequencies that are lower than the three resonating frequencies of the trunk. The frequency response at the three frequencies f, $f_1$ and $f_2$ will be of a double resonator type and thus the antenna arrangement will cover increased bandwidths at these three frequencies.

As illustrated on FIG. 8*f*, as a consequence of the dimensioning of the branch 810*e*, only frequency $f_1$ will have an increased bandwidth thanks to the double resonator structure created between $f'_1$(812*f*) and $f_1$.

As illustrated on FIG. 8*h*, as a consequence of the dimensioning of the branch 810*g*, only frequency $f_2$ will have an increased bandwidth thanks to the double resonator structure created between $f'_2$ (813*h*) and $f_2$.

As illustrated on FIG. 8*j*, as a consequence of the dimensioning and positioning of the branch 810*i*, only frequency $f_1$, 812*j*, will have an increased bandwidth, due to the resonating frequency $f'_1$, 814*j*, of the branch, while the frequencies f and $f_2$ will be shifted to new values f', 811*j*, and $f'_2$, 813*j*.

The examples above are only illustrative of some embodiments of the invention. A person of ordinary skill may contemplate other embodiments, depending on the application that is targeted.

For instance, further branches may be added to a previous branch, instead of being added directly to the trunk. Such an example is displayed on FIG. 8*k*.

Figure 9A:
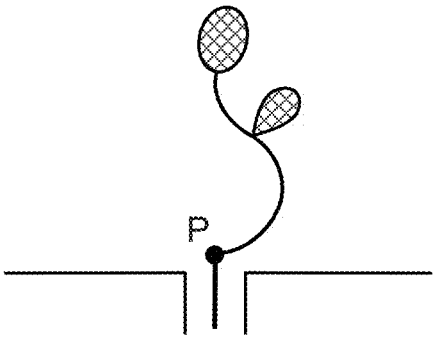
FIGS. 9*a* and 9*b* respectively represent a schematic of an antenna arrangement of the prior art with a monopole antenna element and a plurality of leaves according to the prior art, and its frequency response.
Figure 9B:
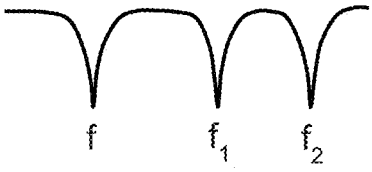

FIGS. 9*a* and 9*b* respectively represent a schematic of an antenna arrangement of the prior art with a monopole antenna element and a plurality of leaves according to the prior art, and its frequency response.

FIG. 9*a* is a schematic of an exemplary embodiment of the prior invention of the same applicant and inventor displayed on FIG. 1*a* (European patent application filed under n° EP2016/306059.3). It has a trunk and two leaves.

FIG. 9*b* represents an approximated frequency response of this exemplary embodiment. One can see that the antenna arrangement is tuned to resonate at three frequencies, f, $f_1$ and $f_2$, one of which is a fundamental mode, the two other being higher order modes. The tuning is performed by placing leaves of definite parameters (lengths, form factors and orientations) at adequate positions, the rules of placing and definition of parameters are defined in European patent application filed under n° EP2016/306059.3.

Figure 9C:
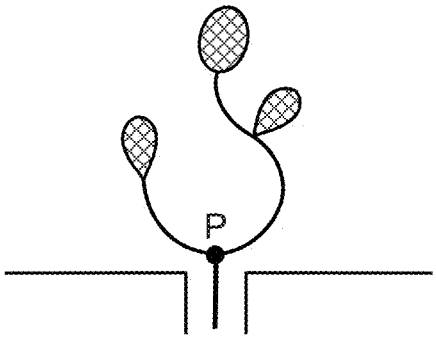
FIGS. 9*c* and 9*e* represent schematics of antenna arrangements with two or three monopole antenna elements and leaves, according to an embodiment of the invention.
Figure 9D:
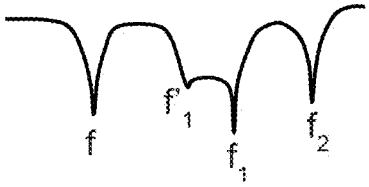
FIGS. 9*d* and 9*f* represent the frequency responses of the antenna arrangements respectively of FIGS. 9*c* and 9*e;*
Figure 9E:
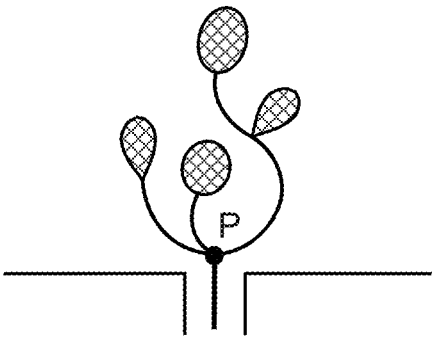

FIGS. 9*c* and 9*e* represent schematics of antenna arrangements with two or three monopole antenna elements and leaves, according to an embodiment of the invention.

FIG. 9*c* is a schematic of an exemplary embodiment of the present invention that is similar in architecture to the prototype displayed on FIG. 2*a*. It has a trunk and two leaves, as the antenna arrangement of FIG. 9*a*. But a branch with a leaf has been added at the feed point of the antenna arrangement that is a Cold Spot for the three frequencies f, $f_1$ and $f_2$.

FIG. 9*e* is a schematic of an exemplary embodiment of the present invention that is similar in architecture to the prototype displayed on FIG. 2*b*. It has a trunk and two leaves, as the antenna arrangement of FIG. 9*a*. But two branches with one leaf each have been added at the feed point of the antenna arrangement that is a Cold Spot for the three frequencies f, $f_1$ and $f_2$.

Figure 9F:
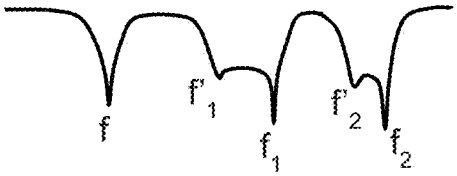

FIGS. 9*d* and 9*f* represent the frequency responses of the antenna arrangements respectively of FIGS. 9*c* and 9*e*.

A single branch has been added at the feed point of the antenna arrangement illustrated on FIG. 9*c*, the branch plus the leaf having a total electrical length $l'_1$.

As illustrated on FIG. 9*d*, this subpart of the antenna arrangement resonates at a frequency $f'_1$ close to $f_1$, where $f'_1=c/4l'_1$ (c being the speed of light in vacuum). The effect of the additional branch is thus to enlarge the bandwidth at which the global antenna arrangement resonates around $f_1$ thanks to the double resonator structure created between $f'_1$ and $f_1$.

In the case of the embodiment displayed on FIG. 9*e*, the two branches each determine a resonating frequency $f'_1$ and $f'_2$, respectively defined as a function of $f_1$ and $f_2$ as explained above. Thus, as displayed on FIG. 9*f*, two bands are created respectively around frequency $f_1$ and around frequency $f_2$ thanks to the two double resonator structures created between $f'_1$ and $f_1$ on one hand and between $f'_2$ and $f_2$ on the other hand.

Figure 10:
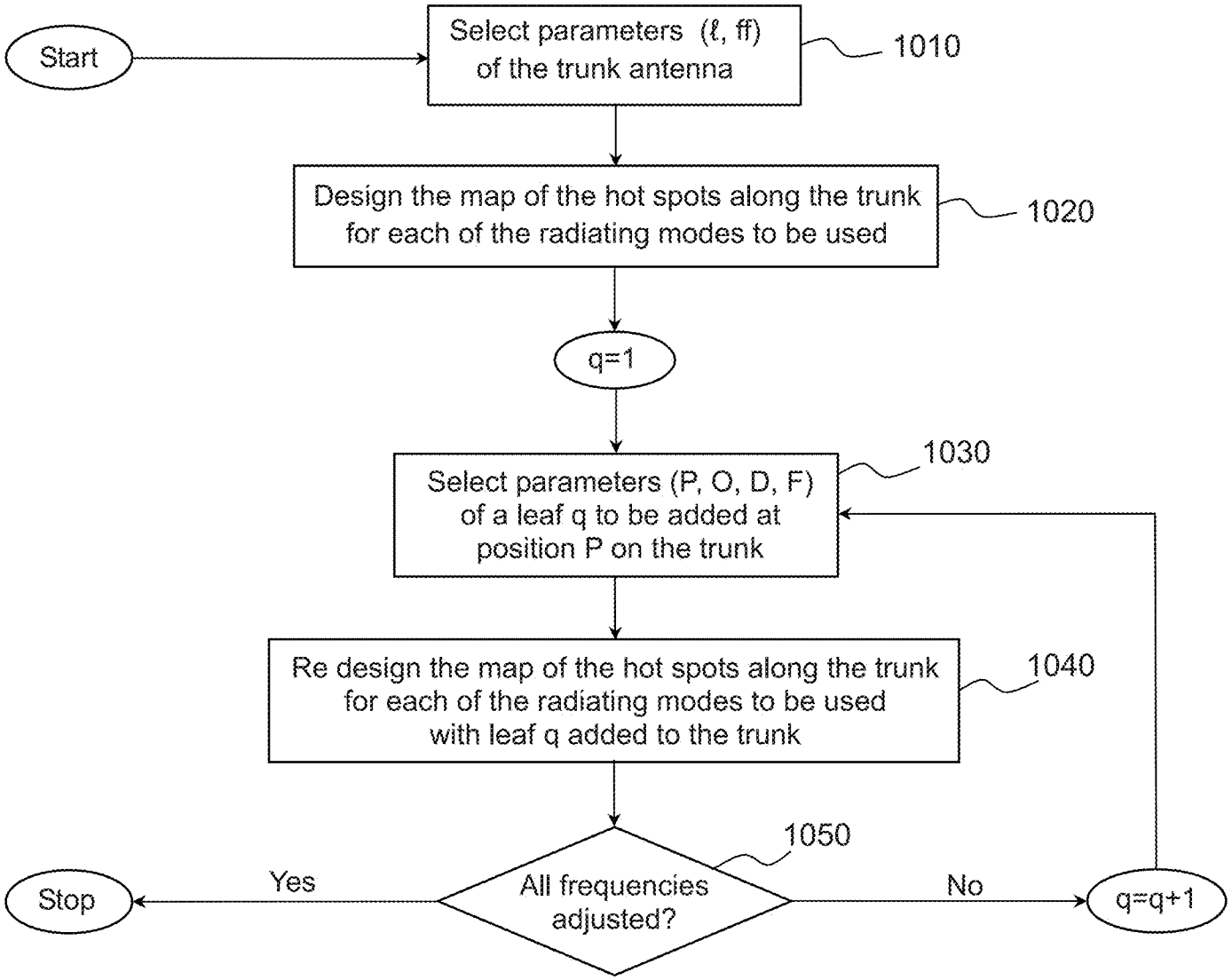
FIG. 10 displays a flow chart of a method to design multiband antenna arrangements according to the prior art.

FIG. 10 displays a flow chart of a method to design multiband antenna arrangements according to the prior art.

The selection of the design rules for a specific application may for example be organized as displayed on FIG. 10.

A first step 1010 of the process consists in selecting the deployed length l and the form factor ff of the wire/ribbon forming the trunk of the antenna arrangement. The frequency of the fundamental mode has to be selected at a value higher than or equal to the targeted lowest frequency, as already discussed above. The form factor to be selected depends on the target size of the antenna arrangement. Also the form factor of the pole may impact the antenna matching. But if the matching is adversely impacted by a specific pole form factor, it may be then corrected using an antenna matching technique. A man of ordinary skill will therefore be able to find an adequate compromise between the compactness form factor and the matching of the antenna arrangement. When the antenna arrangement is correctly matched (at a level equal to or better than −10 dB, for instance), the form factor of the trunk will have little impact on the available bandwidth.

Then, at a step 1020, the positions of the Hot Spots and Cold Spots along the pole for each radiating mode are calculated and/or represented on a map as explained above in relation to FIGS. 7*a*, 7*b* and 7*c*.

Then, at a step 1030, the position P, orientation O, longer dimension D, form factor F have to be determined for a number of leaves q which is set on initialization at 1 and then iteratively increased by one unit until all the target frequencies have been obtained.

The first leaf (q=1) is placed so as to tune the frequency of the fundamental mode (if needed). There is only one single zone on the pole which is electrically sensitive for this mode. It is located close to the distal extremity of the pole which is in Open Circuit. There is therefore only one degree of freedom for this fundamental frequency. The parameters P, O, D, F should be selected so as to adjust a value of the frequency shift, $\Delta f=g(k, P, O, D, F)$. The amplitude of the frequency shift created by a leaf having defined parameters P, O, D and F will depend on the order k of the mode: the higher the order, the higher the variation of the frequency shift for a defined displacement of the leaf around a Hot Spot. O is selected based on the form factor of the trunk, to maximize compactness of the whole volume of the antenna arrangement, while minimizing electric coupling with the trunk. D and F are the main factors impacting Δf for a defined P at a defined order of the mode. Function g is used to create a "desired impact" of the P, O, D and F parameters on one or more of an antenna arrangement impedance, an antenna arrangement matching level or a bandwidth of the electromagnetic radiation, once the radiating frequency itself has been tuned.

Parameters O, D and F can be set in whatever order, once the position P of the leaf has been determined.

If this leaf is placed close to positions which are Hot Spots for other modes, the radiating frequencies of these other modes will also be shifted. The magnitude of the shift may depend on the position of this leaf relative to the Hot Spot positions for these other modes.

At step 1040, the map of Hot Spots and Cold spots is redesigned after leaf q has been added with the same process.

At step 1050, whether all frequencies have been adjusted to their target values or not is tested. If so, the process stops and the design rules are complete. If not, a leaf q+1 should be added to adjust the frequency of a higher order mode. A new leaf is added at a position P that is a Hot Spot for this mode and a Cold Spot for a lower order mode which was previously adjusted. As discussed earlier, higher order modes have a higher number of Hot Spots and hence have a higher number of degrees of freedom.

Figure 11:
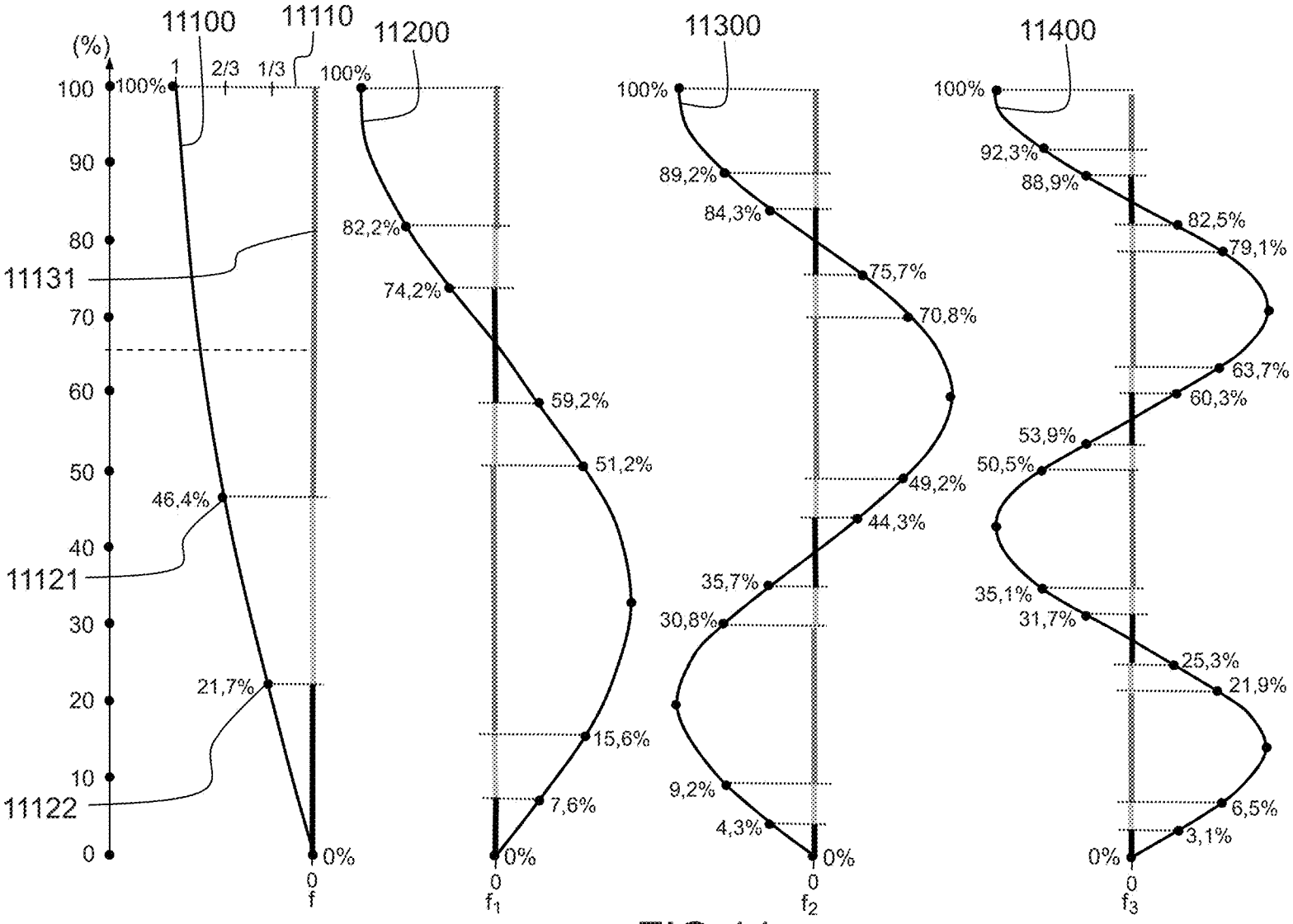
FIG. 11 represents a diagram of the electric field in the fundamental mode and the $1^{st}$ to $3^{rd}$ higher order modes for an antenna arrangement according to the prior art.

FIG. 11 represents a diagram of the electric field in the fundamental mode and the $1^{st}$ to $3^{rd}$ higher order modes for an antenna arrangement according to the invention.

These figures represent a map of the Hot Spots and Cold Spots, the principles of which have already been explained above notably in relation to FIGS. 7*a* to 7*c*.

Four modes are represented by curves 11100, 11200, 11300 and 11400. By way of example only, the abscissa represents the amplitude of the field, with cut-off values at ⅓ of the amplitude, ⅔ of the amplitude and 100% of the amplitude (scale 11110). Other cut-off values could be selected without departing from the scope of the invention. The ordinate represents the percentage of the length of the deployed trunk element of the antenna arrangement. Ordinates corresponding to the cut-off values are indicated on the curves at points 11121, 11122, etc. The areas around the Hot Spots corresponding to the cut-off values are marked along the pole, 11131. While they are only designated by reference numerals for the fundamental mode f for the sake of readability of the figure, it can be easily understood that the corresponding values and marks have the same meaning for the higher order modes. The areas marked as corresponding to ⅔ to 100% of the amplitude are the areas for which a variation of the position of the leaves will have a significant impact on the shift in frequency, a variation of the position of the leaves having a limited impact or no impact at all on the shift in frequency in the other areas. Areas included within the proximal cut-off values of a Hot Spot will be designated as being "near" the position of this Hot Spot. By way of example only, for the fundamental frequency, the area where a variation of the position of the leaf will have a significant impact on the shift in frequency is located between the top of the pole and a position corresponding to an intensity of ⅔ of the maximum amplitude, that corresponds to amplitude value 11121 that equals 46.4% of the total length l of the pole, starting from the feed point 810. This area may be designated as a hot area. From this position down to a position corresponding to 21.7% of l and to ⅓ of the amplitude, a variation of the position of a leaf will have limited impact on the shift in frequency. This area may be designated as a "tepid area". From this last position to the feed point 810, a variation of the position of a leaf will have no impact on the shift in frequency. This area may be designated as a cold area. Similar comments and reasoning apply to the spots placed for the other higher order modes represented by curves 11200, 11300 and 11400.

The map of FIG. 11 allows placing the leaves according to the method described above in relation to FIG. 10.

FIG. 12 represents a table of electric sensitivities along the antenna in the fundamental mode and the $1^{st}$ to $3^{rd}$ higher order modes for an antenna arrangement according to the invention.

The figure includes two tables 12100 and 12200.

Table 12100 represents with different symbols 12121, 12122, 12123 the spots along the pole that belong respectively to a hot area, a tepid area and a cold area. The representation includes a scale 12110 graduated, by way of example only, every 5% of the length l of the deployed pole. On the scale for the fundamental mode, there is only one symbol, whereas for the higher order modes, there are two symbols. The two symbols illustrate the fact that the marked spot is in-between two areas for this mode.

Table 12200 represents a conversion of the symbols of table 12100 into an index of sensitivity of the shift in frequency for the mode to a variation of the position of a leaf. By way of example only, the index is chosen on a scale from 0 to 6. But another scale may be chosen without departing from the scope of the invention. Table 12300 displays the rule of conversion chosen in this example. But other rules of conversion may be chosen. Table 12200 allows to get a clear view of the impact of variations in positions of the leaves along the pole for all the frequencies.

In some embodiments of the invention, variables defining a rate of impact of a position of a leaf for each mode may be determined and a function defining the combination of at least some, if not all, the variables may also be determined using calculation, simulation or abaci.

FIG. 13 represents a table to assist in the selection of the positioning of the leaves to adjust the values of some frequencies selected among the fundamental mode and the $1^{st}$ to $3^{rd}$ harmonic modes for an antenna arrangement according to the invention.

From table 12200 of FIG. 12, it is possible to determine which frequencies the position of a leaf will impact or not impact. For instance, a leaf placed at 85% of the length l of the pole will impact modes f and $f_1$, whereas a leaf placed at 60% of l will impact modes f and $f_2$.

It is thus possible, according to the invention, to define placement rules of the leaves and of the branches that are added to the trunk of the antenna arrangement, using the method now described below in relation to FIG. 14.

Figure 14:
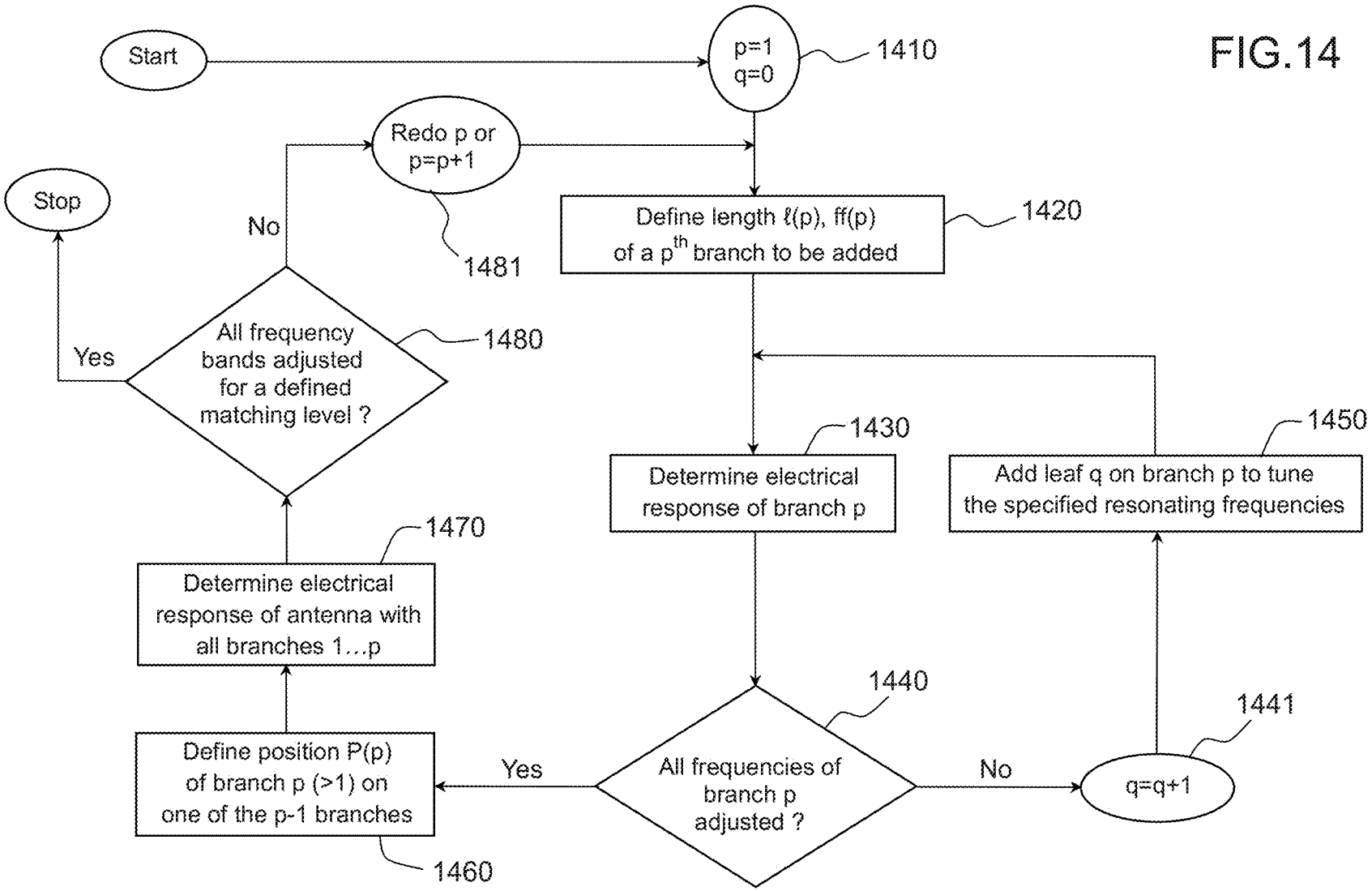
FIG. 14 displays a flow chart of a method to design antenna arrangements according to some embodiments of the invention.

FIG. 14 displays a flow chart of a method to design antenna arrangements according to some embodiments of the invention.

When starting a design of an antenna arrangement according to the invention, the parameters of a first main conductive element with no leaves (or trunk of the bonsai antenna arrangement) are determined at a step 1410 (p=1; q=0). At a step 1420, its length is set at a value e so that the corresponding resonating frequency of this element is equal to or higher than the targeted lowest resonating frequency of the antenna arrangement. The other parameters of this element are determined as explained above in relation to FIG. 10. Notably, its form factor ff is determined according to the specification corresponding to the use case, taking due account of the volume that is available in or around the communication device it is to be connected to.

Its electrical response is determined at a step 1430. Determination of the electrical response may be made either using an electromagnetic radiation simulation tool such as CST™, HFSS™, Feko™ or Comsol™, or any other proprietary software. It may also be performed by a combination of calculations such as those illustrated on FIG. 11 to determine the adequate position P(q) of a leaf q to adjust a frequency $f_i$ and experiments to confirm the impact of other parameters (O, D, F) as defined above.

Until all frequencies of branch p are adjusted (Yes output of the test 1440), a new leaf q+1 is added (1441, 1450) and its impact on the electrical response of the branch is checked (1430). New leaves will be added only to tune either the value or the bandwidth of the frequencies specified for the antenna arrangement.

When all frequencies for this branch p have been adjusted, the position P(p) of this branch on one of the (p−1) previous branches is determined (step 1460). In the case where p=1 (i.e. design of the trunk), the position is well defined: it is the feed point 810 of the antenna arrangement. The $p^{th}$ additional branch should be located at a Cold Spot for one of the frequencies for which the bandwidth should be broadened as defined by the specification. A maximum orthogonality with the radiating elements previously implanted will be obtained by positioning the new branch at the feed point of the branch/trunk with which the new branch should form a resonating structure of an order at least equal to two.

Then the global electrical response of the antenna arrangement should be determined at a step 1470 to check whether the specifications (target matching level across the target bandwidth at frequency $f_i$) are all met. This may also be done using an electromagnetic radiation simulation tool of the type already mentioned and/or performing experiments.

Until all the frequency bands of the specification have been adjusted at the desired matching level (Yes output of test 1480=>Stop), the previous loop is replayed (1481), either with the same branch (Redo p) by changing some of the parameters P, O, D, F of some of the leaves or by adding a new leaf or by changing the position of the branch p, or by adding a new branch (p=p+1).

The invention may also be applied to dipole antennas. A dipole antenna is a two poles antenna where the two poles are excited by a differential generator. The two poles of the dipole antenna each operate with stationary regimes which have the same behavior. The two pole antennas each have a structure with a trunk, one or more branches and one or more leaves. In some embodiments of the invention, the two structures are symmetrical relative to a plane orthogonal to the ground plane.

The examples disclosed in this specification are therefore only illustrative of some embodiments of the invention. They do not in any manner limit the scope of said invention which is defined by the appended claims.

The invention claimed is:

1. An antenna arrangement comprising:

a first main conductive element configured to radiate above a defined frequency of electromagnetic radiation;

one or more first secondary conductive elements located at one or more positions defined on the first main conductive element as a function of positions of nodes of current of electromagnetic radiation of selected harmonics of the electromagnetic radiation;

at least a second main conductive element:

configured to form with at least parts of the antenna arrangement a resonating structure of an order higher than one at a frequency of one of the selected harmonics of the electromagnetic radiation; and having a feed connection located at a position on another main conductive element that is defined as a function of positions of bellies of current of one of the selected harmonics of the electromagnetic radiation.

2. The antenna arrangement of claim 1, wherein the resonating structure of an order higher than one is matched at a level equal to or greater than a predefined level across bandwidth defined around the frequency of one of the selected harmonics of the electromagnetic radiation.

3. The antenna arrangement of claim 1, wherein the at least a second main conductive element comprises one or more second secondary conductive elements located at one or more positions defined on the second main conductive element as a function of positions of nodes of current of the one of the harmonics of the electromagnetic radiation.

4. The antenna arrangement of claim 1, wherein the at least a second main conductive element has a total electrical length that is defined as function of an odd integer multiple of a quarter of a wavelength at the frequency of the one of the harmonics of the electromagnetic radiation.

5. The antenna arrangement of claim 4, wherein the bandwidth is equal to or larger than a predefined percentage value of the frequency of the one of the selected harmonics of the electromagnetic radiation across which the antenna arrangement is adapted.

6. The antenna arrangement of claim 4, wherein the antenna arrangement is adapted across the bandwidth surrounding the frequency of the one of the selected harmonics of the electromagnetic radiation at a level equal to or greater than an absolute predefined value.

7. The antenna arrangement of claim 1, wherein one or more of the first main conductive elements or the second main conductive elements are a metallic ribbon and/or a metallic wire.

8. The antenna arrangement of claim 1, wherein one or more of the first main conductive elements and the second main conductive element has one of a 2D or 3D compact form factor.

9. The antenna arrangement of claim 8, deposited by a metallization process on a non-conductive substrate layered with one of a polymer, a ceramic or a paper substrate.

10. The antenna arrangement of claim 1, tuned to radiate in two or more frequency bands, comprising one or more of an ISM band, a WiFi band, a Bluetooth band, a 3G band, a LTE band and a 5G band.

11. A method of designing an antenna arrangement comprising:

defining a geometry of a first main conductive element to radiate above a defined frequency of electromagnetic radiation;

locating one or more first secondary conductive elements at or more positions defined as a function of positions of nodes of current of electromagnetic radiation of selected harmonics of the electromagnetic radiation;

defining a total electrical length or a frequency of a fundamental mode of at least a second main conductive element to form with at least parts of the antenna arrangement a resonating structure of an order higher than one configured to resonate at a frequency of one of the selected harmonics of the electromagnetic radiation;

locating a feed connection of the at least a second main conductive element at a position on another main conductive element that is defined as a function of positions of bellies of current of electromagnetic radiation of the one of the selected harmonics of the electromagnetic radiation.

12. The method of claim 11, wherein the resonating structure of an order higher than one is matched at a level equal to or greater than a predefined level across the bandwidth defined around the frequency of one of the selected harmonics of the electromagnetic radiation.

13. The method of one of claim 11, further comprising locating one or more second secondary conductive elements at one or more positions defined on the second main conductive element as a function of positions of nodes of current of one of the harmonics of the electromagnetic radiation.

14. The method of one of claim 11, further comprising: i) defining a total electrical length or a frequency of a fundamental mode of at least an additional main conductive element to form with at least parts of the antenna arrangement a resonating structure of an order higher than one configured to resonate at a frequency of one of the selected harmonics of the electromagnetic radiation, the total electrical length and the selected harmonics being determined as functions of a length of the additional main conductive element and of orientation, main dimension and form factor of the secondary conductive elements positioned on the additional main conductive element; locating a feed connection of the additional main conductive element at or close to a position on another main conductive element that is defined as a function of positions of bellies of current of electromagnetic radiation of the another one of the harmonics of the electromagnetic radiation; iii) iterating until predefined levels of matching are achieved across target bandwidths around a number of frequencies are achieved, subject to preserving previously controlled frequencies, bandwidths and matching levels.

15. An antenna arrangement comprising:

a first main conductive element configured to radiate above a defined frequency of electromagnetic radiation;

one or more secondary conductive elements located at or more positions defined on the first main conductive element as a function of positions of nodes of current of electromagnetic radiation of harmonics of the electromagnetic radiation;

at least a second main conductive element having a total electrical length that is adapted to enlarge a frequency band around a frequency of one or more selected harmonics of the electromagnetic radiation so as to transmit/receive RF signals at or above a predefined quality of service.

* * * * *